US007179128B2

(12) United States Patent
Iwata et al.

(10) Patent No.: US 7,179,128 B2
(45) Date of Patent: Feb. 20, 2007

(54) FUSE

(75) Inventors: Masashi Iwata, Haibara-gun (JP); Norihiro Ohashi, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/527,464

(22) PCT Filed: Feb. 18, 2004

(86) PCT No.: PCT/JP2004/001826

§ 371 (c)(1),
(2), (4) Date: Mar. 11, 2005

(87) PCT Pub. No.: WO2004/081961

PCT Pub. Date: Sep. 23, 2004

(65) Prior Publication Data

US 2006/0035495 A1 Feb. 16, 2006

(30) Foreign Application Priority Data

Mar. 12, 2003 (JP) ..... 2003-066974

(51) Int. Cl.
*H01R 13/68* (2006.01)

(52) U.S. Cl. ..... 439/621

(58) Field of Classification Search ..... 439/621, 439/622; 337/186, 187, 201
See application file for complete search history.

(56) References Cited

U.S. PATENT DOCUMENTS 4,845,592 A * 7/1989 Himes et al. ..... 361/775
5,239,282 A 8/1993 Filomia
5,629,663 A * 5/1997 Seki et al. ..... 337/186
5,662,496 A * 9/1997 Kanamori ..... 439/621
5,666,865 A * 9/1997 Ito ..... 81/3.8
5,739,739 A * 4/1998 Muramatsu et al. ..... 337/234
5,739,741 A * 4/1998 Hanazaki et al. ..... 337/290
5,841,337 A * 11/1998 Douglass ..... 337/198
6,828,896 B2 * 12/2004 Ohashi et al. ..... 337/205
2004/0192113 A1 * 9/2004 Yamashita et al. ..... 439/621

FOREIGN PATENT DOCUMENTS

DE 88 14 927 U 1/1989

(Continued)

OTHER PUBLICATIONS

International Search Report for PCT/JP2004/001826 dated Jan. 16, 2004.

*Primary Examiner*—Tulsidas C. Patel
*Assistant Examiner*—Phuongchi Nguyen
(74) *Attorney, Agent, or Firm*—Sughrue Mion, PLLC

(57) ABSTRACT

A fuse 1 of the present invention includes a fuse body 32, a housing 33 which is made of an insulative resin, and receives and holds the fuse body therein, the fuse body being inserted into the housing through an upper opening in the housing, and a cover 34 which is made of an insulative resin, and covers the upper opening in the housing. Retaining portions 50, corresponding respectively to retaining claws 47 of a withdrawing jig for withdrawing the housing, are formed at a side surface of the housing. Therefore, the retaining claws of the withdrawing jig can be positively fixed to the housing, and a relatively large force is not required for the withdrawing operation, and therefore the withdrawing operation can be effected efficiently.

6 Claims, 9 Drawing Sheets

FOREIGN PATENT DOCUMENTS

| | | | |
|---|---|---|---|
| EP | 710974 | A | 5/1996 |
| JP | 8-017328 | A | 1/1996 |
| JP | 2001-195971 | A | 7/2001 |
| JP | 2002-140976 | * | 5/2002 |
| JP | 2004-281078 | * | 10/2004 |

* cited by examiner

FUSE

TECHNICAL FIELD

This invention relates to a fuse used for protecting an electric circuit in an electrical equipment mounted on an automobile or the like, and more particularly to a housing structure of a fuse which enables the fuse to be easily withdrawn.

BACKGROUND ART

In recent years, various electrical equipments have been mounted on an automobile, and many fuses for protecting various electronic devices, used in electric circuits of the electrical equipments, are received in a fuse box or the like.

A conventional fusible link 1, shown in FIGS. 7 and 8, is a so-called plug-in type fuse, and comprises a fuse body 2 made of a metal sheet, a housing 3 which is made of an insulative resin, and has the fuse body 2 received and held therein (the fuse body 2 is inserted into the housing 3 through an upper opening of a rectangular shape in the housing 3), and a cover 4 which is made of an insulative resin, and covers the upper opening in the housing 3.

As shown in FIG. 8, the fuse body 2 includes a strip-like fusible conductor portion 10 having a melting portion 10*a*, and a pair of female terminal portions 11 and 11 which are formed respectively at both ends of the fusible conductor portion 10, and can be fittingly connected respectively to mating tab terminals 15 formed on a circuit provided at a fuse mounting portion 13. This fuse body 2 is formed into an integral construction, using a metal sheet.

The cover 4 includes a lid 5 in the form of a generally rectangular plate, and a pair of lock piece portions 6 and 6 extending downwardly respectively from opposite end edges of the lid 5, and this cover 4 is molded into an integral construction, using a transparent plastics material. Retaining projections 7 are formed on and project respectively from those portions of a peripheral wall of the housing 3 corresponding respectively to the lock piece portions 6. When the pair of elastic lock piece portions 6 and 6 are retainingly engaged with the retaining projections 7, respectively, the cover 4 is locked to the housing 3 in such a manner that this cover 4 covers the upper opening in the housing 3.

The fusible link 1 is mounted in the fuse mounting portion 13 formed at an electric connection box such as a fuse box, and the fuse body 2 is electrically connected to the mating tab terminals 15. A fuse guide wall 14 for supporting the housing 3 is formed at the fuse mounting portion 13, and this fuse guide wall 14 serves to guide the insertion of the fusible link 1 at the time of mounting the fusible link, and also serves to prevent the fusible link 1 from being displaced out of position after the fusible link is mounted.

Electric connection boxes such as a fuse box have increasingly been required to have a compact and lightweight design and a cost-reduced design, and in this connection fuses also have been required to have a compact and lightweight design.

Therefore, for example, when a fuse body 22 as well as a housing 23 is formed into a compact design as in a fusible link 21 shown in FIG. 9, this fusible link can be much more reduced in size and weight to have a reduced height as compared with the conventional fusible link 1 shown in FIG. 7. As a result, the compact and lightweight design of the electric connection box is achieved.

In the fuse body 22, secondary short-circuiting or the like must be prevented when a fusible conductor portion 28 melts, and therefore it is difficult to further reduce the distance between a pair of female terminal portions 29 and 29.

Therefore, horizontal dimensions and shapes of the fuse body 22 and housing 23 are substantially the same as those of the fuse body 2 and housing 3 of the fusible link 1, and a cover 24 has the same shape as that of the cover 4, and the cover 24 is locked to the housing 23 by lock piece portions 26 retainingly engaged respectively with retaining projections 27 formed on and projecting from a peripheral wall of the housing 23.

JP-A-2001-325875, mentioned below, discloses a plug-in type fuse body which is inserted into a housing of an insulative resin through an upper opening thereof, and is received and held therein. In this plug-in type fuse, spring properties of holder springs of two female terminal portions are enhanced, and besides a resistance is reduced so that this fuse can meet a high rating.

JP-A-8-185797, mentioned below, discloses a fusible link in which a cover of a transparent plastics material, having a rated current value indicated thereon, is fitted on an upper opening portion of a housing, and a recess or a projection which can be detected by a sensor is provided at an inner surface of the cover at a position different depending on the rated current value.

However, in the above conventional fusible links comprising the cover, the housing, and the fuse body, any retaining portion, corresponding to a retaining portion of a withdrawing jig, is not provided at a side surface of the housing, and therefore when withdrawing the housing, the jig is liable to be disengaged from the housing, and therefore a relatively large force is required for this withdrawing operation, and therefore there has been encountered a problem that the efficiency of the withdrawing operation is low.

Another problem is that there is a fear that the housing is damaged when a large force for withdrawing purposes is applied to the side surface of the housing.

DISCLOSURE OF INVENTION

It is an object of this invention to provide a fuse in which a large force is not required for withdrawing the fuse, and the withdrawing operation can be effected efficiently.

According to the invention, there is provided a fuse comprising a fuse body; a housing which is made of an insulative resin, and receives and holds the fuse body therein, the fuse body being inserted into the housing through an upper opening in the housing; and a cover which is made of an insulative resin, and covers the upper opening in the housing; characterized in that: retaining portions, corresponding respectively to retaining claws of a withdrawing jig for withdrawing the housing, are formed at a side surface of the housing.

In the fuse of the above construction, the retaining portions, corresponding respectively to the retaining claws of the withdrawing jig, are formed at the side surface of the housing, and therefore the withdrawing jig can be positively engaged with the fuse, and a large force is not required for withdrawing the housing, and therefore the withdrawing operation can be effected efficiently without damaging the housing.

The fuse of the invention is further characterized in that the retaining portion includes a first ridge portion which is formed at an upper portion of the side surface of the housing, and is disposed perpendicularly to a longitudinal axis of the housing, and two second ridge portions which extend perpendicularly from opposite ends of the first ridge portion, respectively, and are disposed parallel to the longitudinal axis of the housing.

In the fuse of the above construction, the retaining portion includes the first ridge portion, and the two second ridge portions which extend perpendicularly from the opposite ends of the first ridge portion, respectively, and are disposed parallel to the longitudinal axis of the housing. With this construction, a higher strength is secured as compared with the case where only the first ridge portion is provided, and therefore even when a relatively large force is applied to the retaining portions when withdrawing the housing by the withdrawing jig, the retaining portions will not be damaged.

BRIEF DESCRIPTION OF DRAWINGS

FIG. 5A is the cross-sectional view showing a condition before the withdrawing jig is connected to the housing, and FIG. 5B is the cross-sectional view showing a condition after the withdrawing jig is connected to the housing.

FIG. 6A is the cross-sectional view showing a condition before the housing is withdrawn from a fuse mounting portion, and FIG. 6B is the cross-sectional view showing a condition after the housing is withdrawn from the fuse mounting portion.

Figure 1:
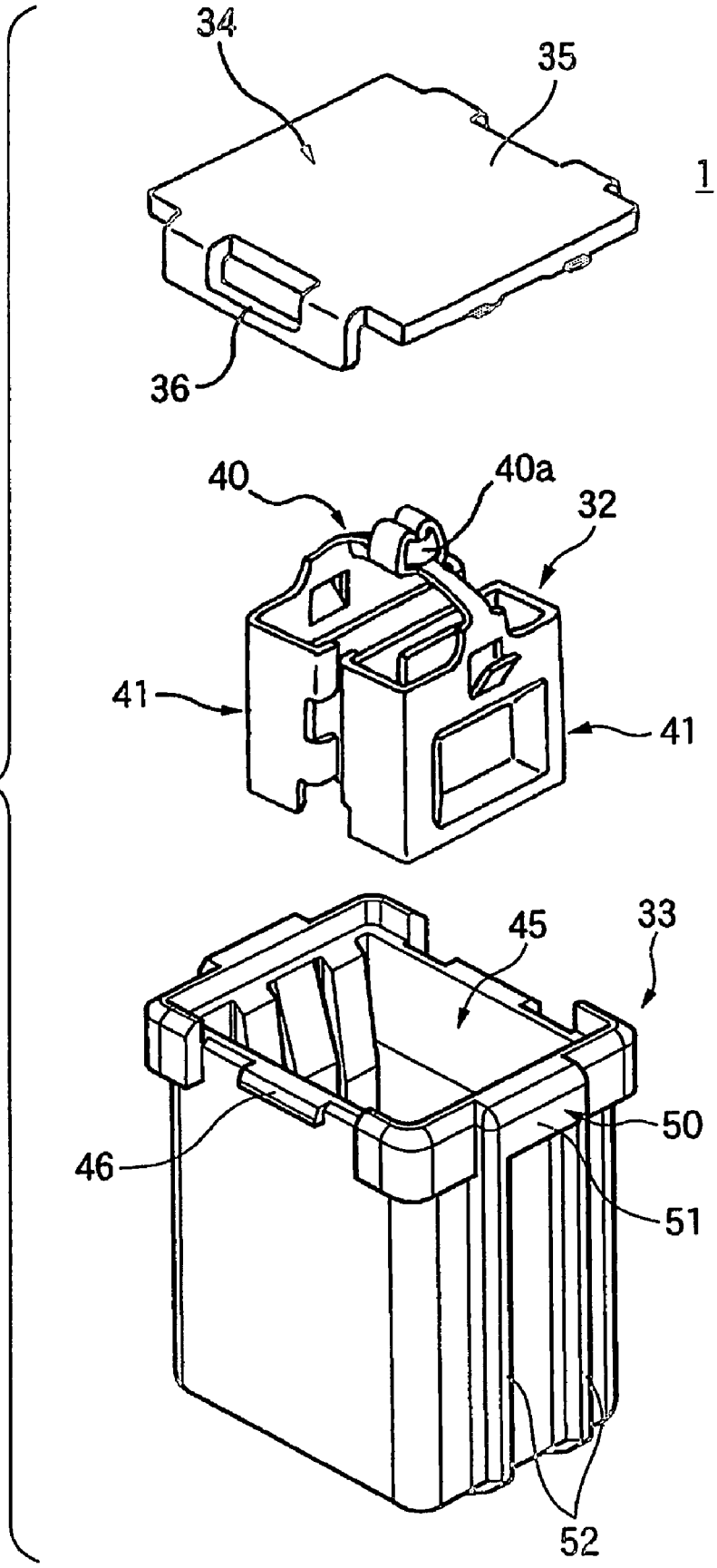
FIG. 1 is a perspective view of one preferred embodiment of a fusible link (fuse) of the invention.

In the figures, Reference numeral 1 denotes fusible link (fuse), 32 is fuse body, 33 is housing, 34 is cover, 35 is lid, 36 is lock piece portion, 45 is upper opening, 46 is retaining projection, 47 is retaining claw, 50 is retaining portion, 51 is first ridge portion, and 52 is second ridge portion.

BEST MODE FOR CARRYING OUT THE INVENTION

Figure 3:
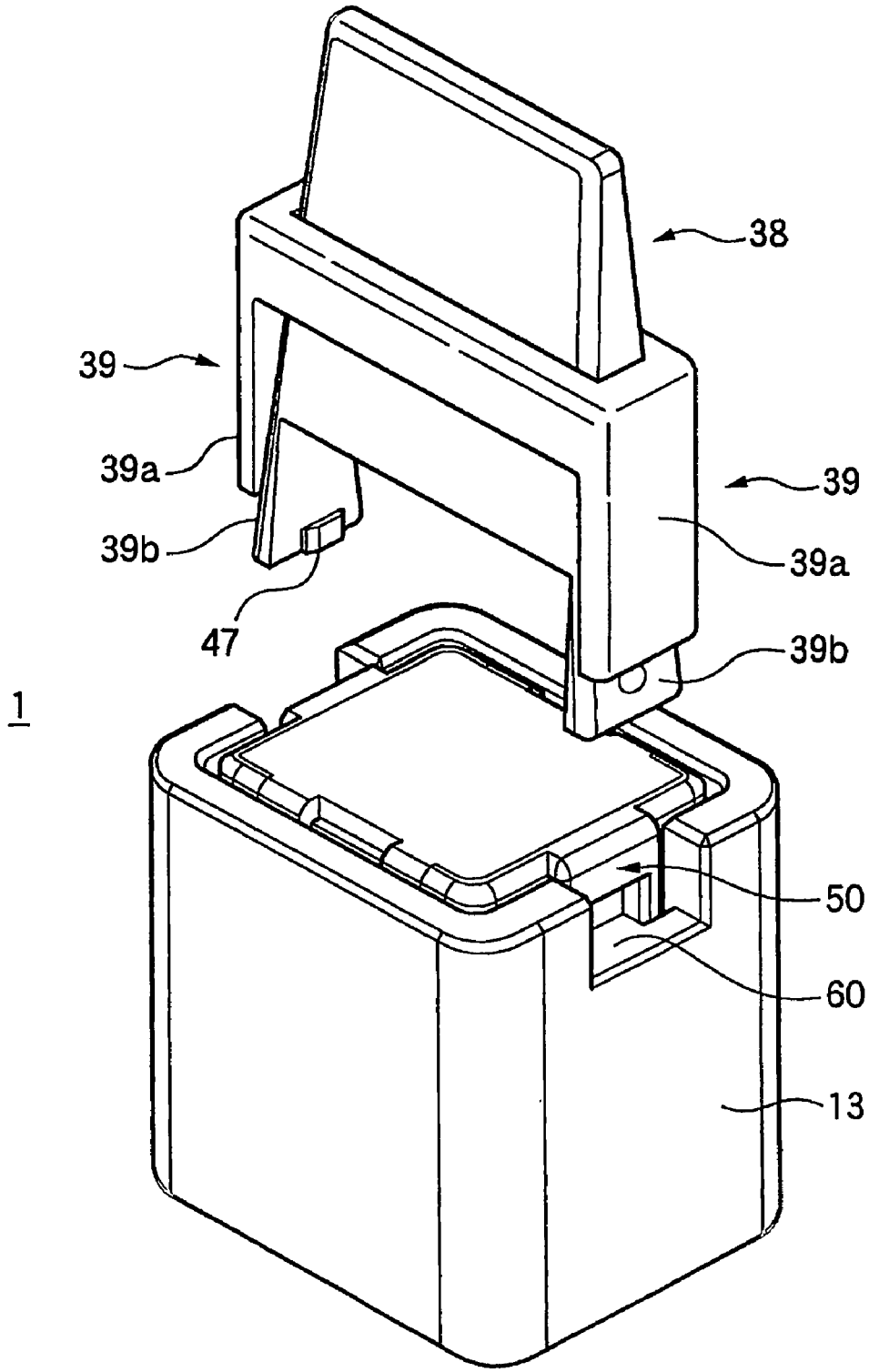
FIG. 3 is a perspective view showing a condition before a withdrawing jig is engaged with the fusible link.
Figure 4:
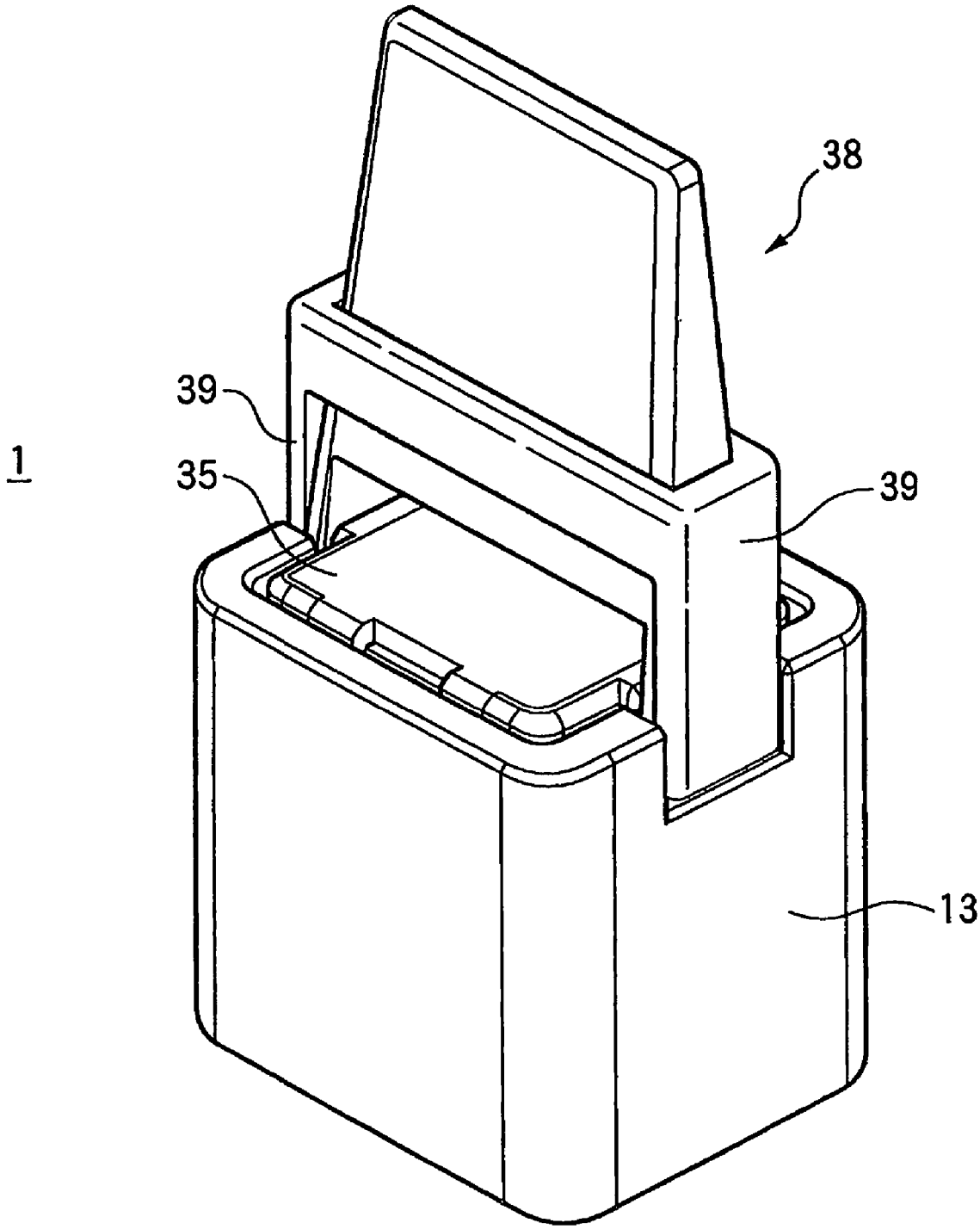
FIG. 4 is a perspective view showing a condition after the withdrawing jig is engaged with the fusible link.

One preferred embodiment of a fuse of the present invention will now be described in detail with reference to FIGS. 1 to 6B. FIG. 1 is an exploded, perspective view of one preferred embodiment of the fusible link (fuse) of the invention, FIG. 2 is a perspective view of the fusible link of FIG. 1, having a lid attached thereto, FIG. 3 is a perspective view showing a condition before a withdrawing jig is engaged with the fusible link, FIG. 4 is a perspective view showing a condition after the withdrawing jig is engaged with the fusible link, and FIGS. 5A, 5B, 6A and 6B are cross-sectional views explanatory of a method of withdrawing the fusible link of FIGS. 3 and 4 from a fuse mounting portion.

As shown in FIG. 1, the fusible link 1 of this embodiment is a so-called plug-in type fuse, and comprises a fuse body 32 made of a metal sheet, the housing 33 which is made of an insulative resin, and has the fuse body 32 received and held therein (the fuse body 32 is inserted into the housing 33 through an upper opening 45 of a rectangular shape in the housing 33), and a cover 34 which is made of an insulative resin, and covers the upper opening 45 in the housing 33.

The fuse body 32 includes a strip-like fusible conductor portion 40 having a melting portion 40*a*, and a pair of female terminal portions 41 and 41 which are formed respectively at both ends of the fusible conductor portion 40, and can be fittingly connected respectively to mating tab terminals 15 formed on a circuit provided at the fuse mounting portion 13. This fuse body 32 is formed into an integral construction, using a metal sheet.

Figure 2:
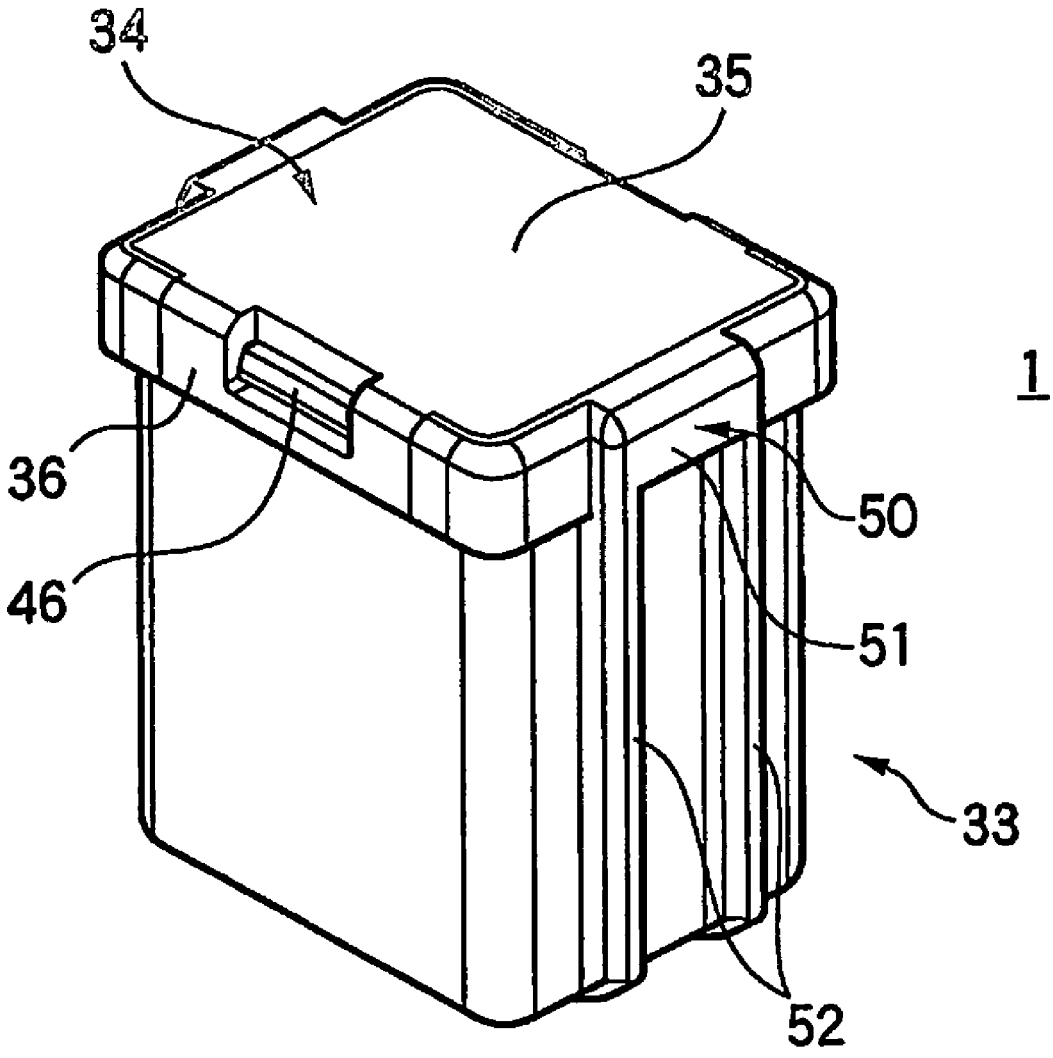
FIG. 2 is a perspective view of the fusible link of FIG. 1, having a lid attached thereto.
Figure 7:
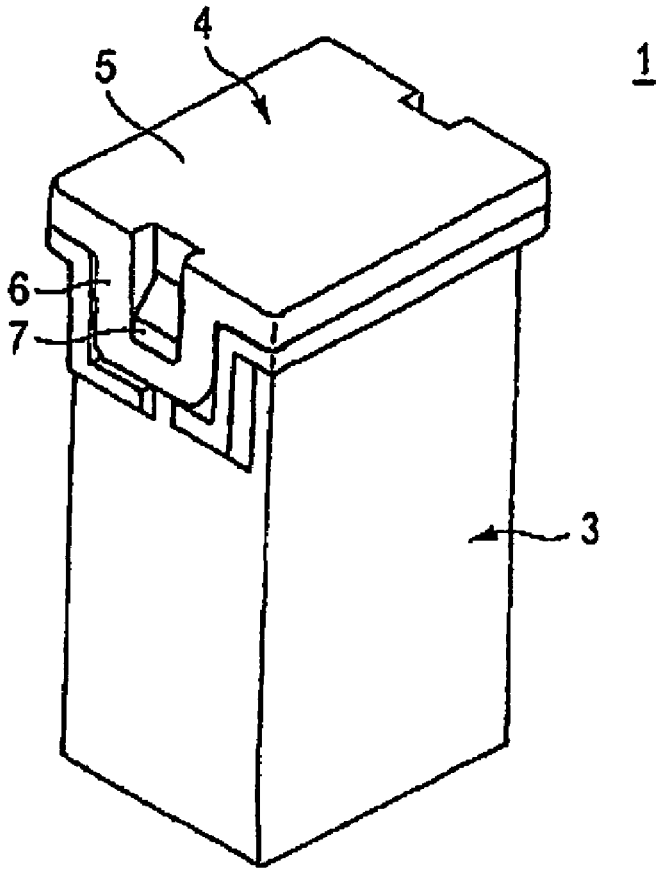
FIG. 7 PRIOR ART
FIG. 7 is a perspective view of a conventional fusible link.
Figure 8:
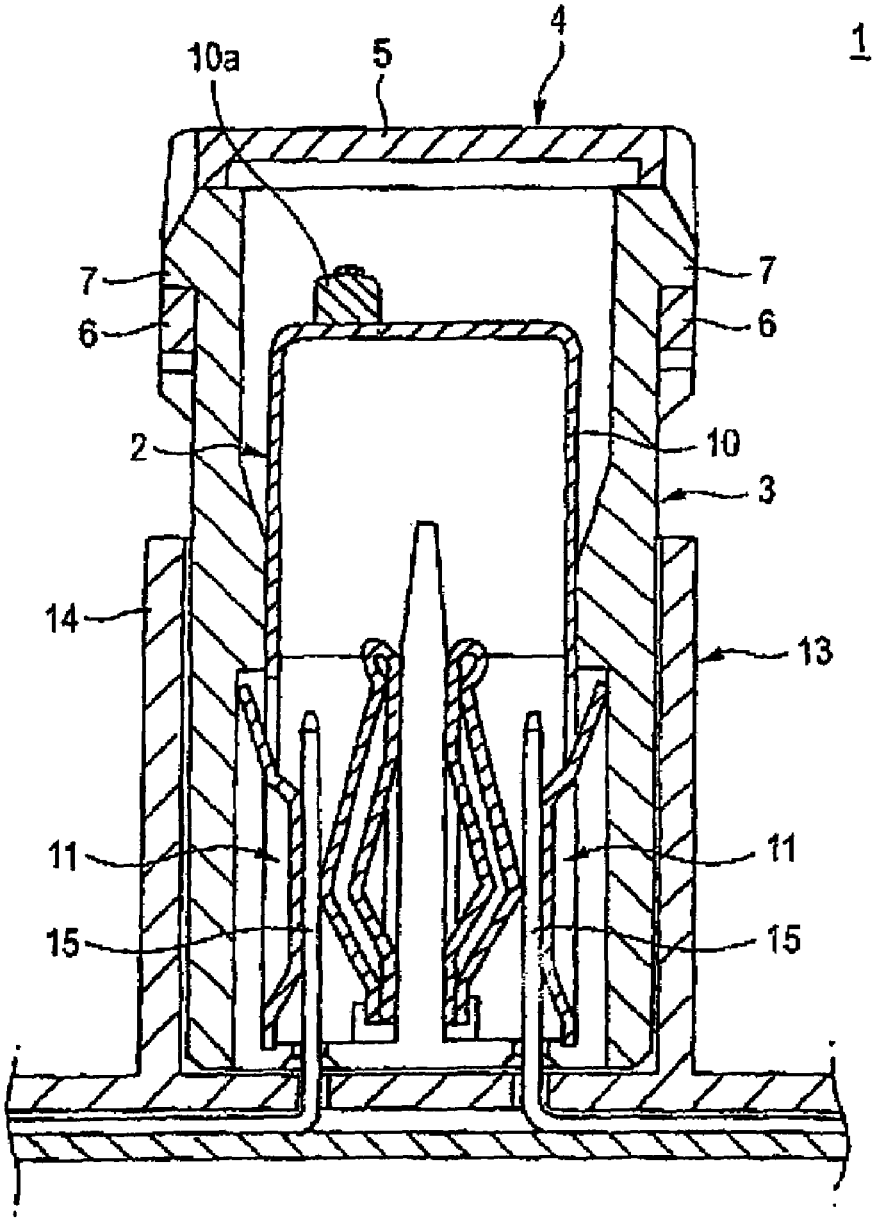
FIG. 8 PRIOR ART
FIG. 8 is a cross-sectional view showing a condition in which the fuse of FIG. 7 is mounted in a fuse mounting portion.
Figure 9:
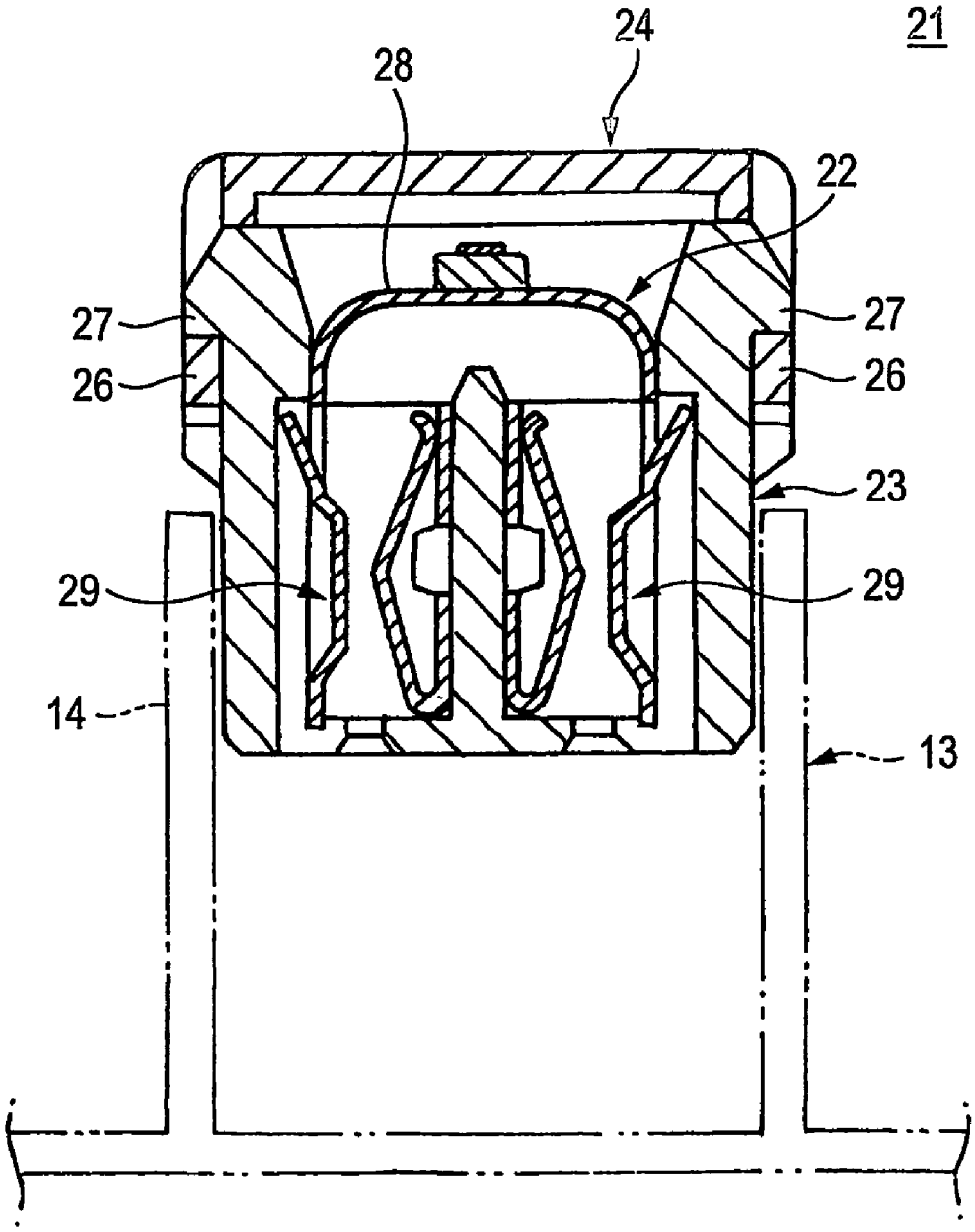
FIG. 9 is a cross-sectional view explanatory of problems encountered when a fuse is formed into a compact design.

As shown in FIGS. 1 and 2, the cover 34 includes the lid 35 in the form of a generally rectangular plate, and a pair of lock piece portions 36 and 36 extending downwardly respectively from opposite end edges of the lid 35, and this cover 34 is molded into an integral construction, using a plastics material. The lock piece portions 36 of the cover 34 are much shorter than the lock piece portions 6 of the cover 4 shown in FIG. 7.

Retaining projections 46 are formed on and project respectively from those portions of an upper edge of a peripheral wall of the housing 33 corresponding respectively to the lock piece portions 36. When the pair of lock piece portions 36 and 36 are retainingly engaged with the retaining projections 46, respectively, the cover 34 is locked to the housing 33 in such a manner that this cover 34 covers the upper opening 45 in the housing 33.

As shown in FIGS. 2 and 3, retaining portions 50, corresponding respectively to retaining claws 47 of the withdrawing jig 38 for withdrawing the housing 33 are formed at the side surface (peripheral surface) of the housing 33. Two legs 39 extend downwardly from opposite sides of the withdrawing jig 38, respectively, and each of the two legs 39 includes an outer leg portion 39*a*, and an inner leg portion 39*b* disposed inwardly of the outer leg portion 39*a*. The retaining claws 47 are formed on inner surfaces of lower ends of the inner leg portions 39*b*, respectively, and are disposed in opposed relation to each other.

Each of the retaining portions 50 includes a first ridge portion 51 which is formed at an upper portion of the side surface of the housing 33, and is disposed perpendicularly to a longitudinal axis of the housing 33, and two second ridge portions 52 and 52 which extend perpendicularly from opposite ends of the first ridge portion 51, respectively, and are disposed parallel to the longitudinal axis of the housing 33.

In the fusible link 1 of the above construction, first, the fuse body 32 is inserted into the housing 33 through the upper opening 45, and is received and held in this housing, and then the upper opening 45 in the housing 33 is covered with the lid 35 of the cover 34, and an outer surface of the lid 35 is pressed, thereby bringing the lock piece portions 36 into retaining engagement with the retaining projections 46, respectively, as shown in FIGS. 1 and 2.

Then, the housing 33 of the fusible link 1 thus assembled is mounted in the fuse mounting portion 13 formed at an electric connection box such as a relay box.

Next, the procedure of withdrawing the fusible link of this embodiment by the use of the withdrawing jig will be described with reference to FIGS. 3 to 6B.

Figure 5A:
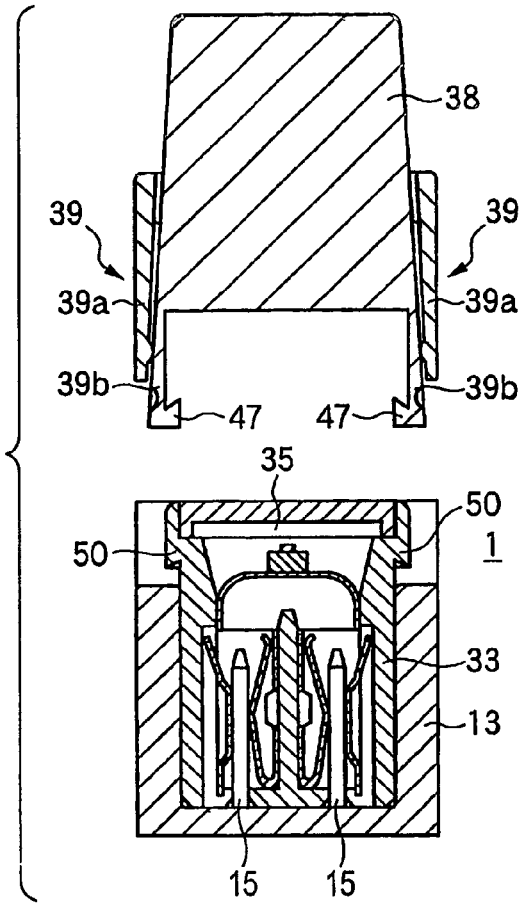
FIGS. 5A and 5B are cross-sectional views explanatory of a method of withdrawing the fusible link of FIG. 3 from a housing.
Figure 5B:
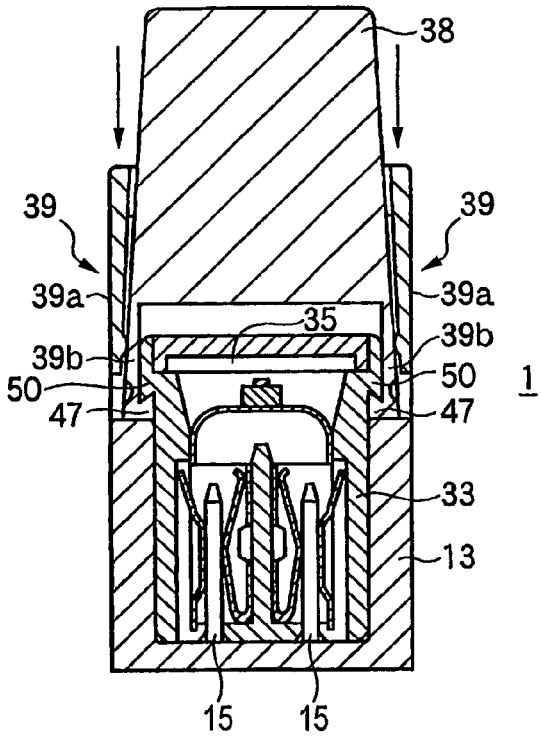
Figure 6A:
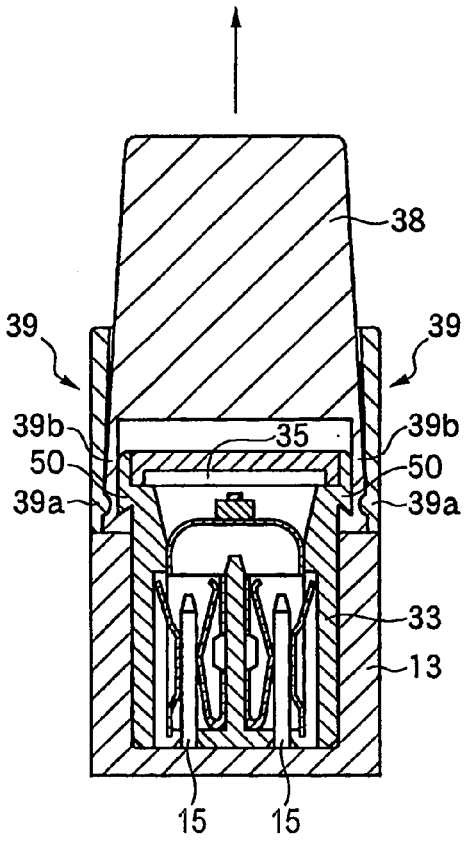
FIGS. 6A and 6B are cross-sectional views explanatory of the method of withdrawing the fusible link of FIG. 4 from the housing.
Figure 6B:
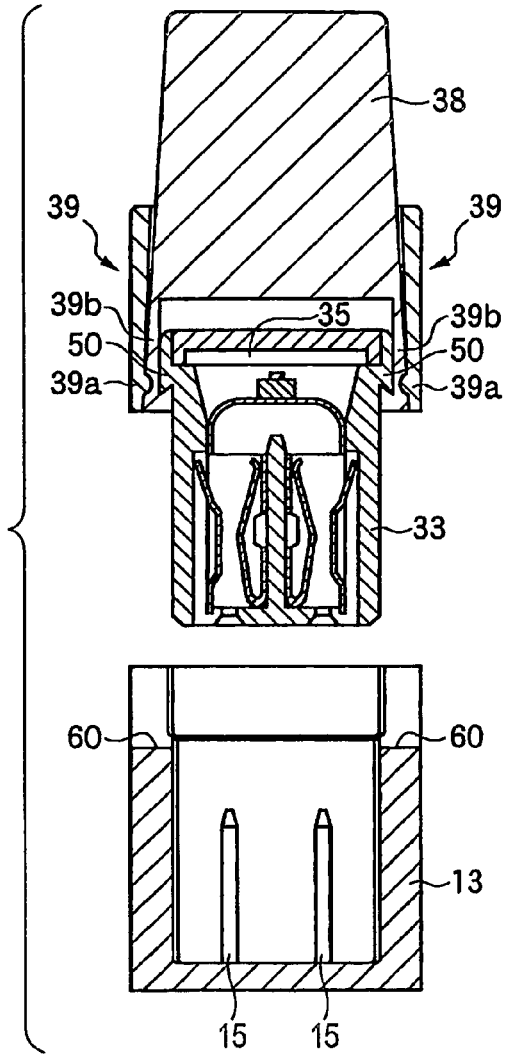

As shown in FIGS. 3 and 5A, the withdrawing jig 38 is moved downward, and the retaining claws 47, formed respectively at the inner leg portions 39*b* of the withdrawing jig 38, are brought into engagement of the retaining portions 50 of the housing 33 of the fusible link 1, respectively. During this engaging operation, each retaining claw 47 abuts against the corresponding ridge portion 51, and then is elastically deformed outwardly, and slides over the ridge portion 51 (see FIG. 2).

At this time, each inner leg portion 39*b* is restored into its original condition by a pressing force applied from the outer leg portion 39*a* to this inner leg portion 39*b*, and at the same time the retaining claw 47 on the inner leg portion 39*b* is brought into engagement with the retaining portion 50 of the housing 33 of the fusible link 1. Lower end portions of the outer legs 39*b* are fitted respectively into recesses 60 (provided for respectively receiving the lower end portions of the outer legs 39*b*) (see FIG. 6B) formed in the fuse mounting portion 13.

Then, when the withdrawing jig 38 is pulled upwardly, the fusible link 1 is withdrawn from the fuse mounting portion 13, with the withdrawing jig 38 kept engaged with the fusible link 1, that is, with the retaining claws 47 of the inner legs 39*b* of the withdrawing jig 38 kept engaged respectively with the retaining portions 50 of the housing 33 of the fusible link 1.

Thus, the retaining portions 50, corresponding respectively to the retaining claws 47 of the withdrawing jig 38, are provided at the side surface of the housing 33, and therefore the withdrawing jig can be positively fixed to the fusible link 1, and the fusible link 1 can be easily withdrawn.

INDUSTRIAL APPLICABILITY

As described above, in the fuse of the invention, the retaining portions, corresponding respectively to the retaining claws of the withdrawing jig for withdrawing the housing, are formed at the side surface of the housing, and therefore the withdrawing jig can be positively engaged with the fuse, and a large force is not required for withdrawing the housing, and therefore the withdrawing operation can be effected efficiently without damaging the housing.

In the fuse of the invention, the retaining portion includes the first ridge portion, and the two second ridge portions which extend perpendicularly from the opposite ends of the first ridge portion, respectively, and are disposed parallel to the longitudinal axis of the housing. Therefore, a higher strength is secured as compared with the case where only the first ridge portion is provided, and therefore even when a relatively large force is applied to the retaining portions when withdrawing the housing by the withdrawing jig, the retaining portions will not be damaged.

The present application is based on Japanese Patent Application No. 2003-66974, the entire contents of which are incorporated herein by reference.

The invention claimed is:

1. A fuse comprising:

a fuse body;

a housing which is made of an insulative resin, and receives and holds said fuse body therein, and into which said fuse body is inserted through an upper opening in said housing; and a cover which is made of an insulative resin and covers said upper opening in said housing;

wherein said housing comprises a retaining portion corresponding to a retaining claw of a withdrawing jig for withdrawing said housing and said retaining portion comprises a first ridge portion which is formed at and protrudes from an upper portion of a side surface of said housing, and is disposed perpendicularly to a longitudinal axis of said housing, and two second ridge portions which protrude from the side surface of said housing, extend perpendicularly from opposite ends of said first ridge portion, respectively, and are disposed parallel to the longitudinal axis of said housing.

2. A fuse according to claim 1, wherein a pair of the retaining portions are provided on opposite side faces of said housing so that the retaining portions are aligned with terminal portions of the fuse body.

3. A fuse according to claim 1, wherein a pair of the retaining portions are provided on opposite side faces of said housing so that the retaining portions are aligned in an extending direction of a fusible portion of the fuse body.

4. A fuse comprising:

a fuse body;

a housing having a tubular shape with a rectangular cross-section which is made of an insulative resin, and receives and holds said fuse body therein, and into which said fuse body is inserted through an upper opening in said housing so that said fuse is connected to mating terminals accommodated in said housing; and a cover which is made of an insulative resin, and covers said upper opening in said housing;

wherein said housing comprises a pair of retaining portions, corresponding to a retaining claw of a withdrawing jig for withdrawing said housing, formed on a first pair of opposite side surfaces of said housing, and a pair of retaining projections for retaining said cover formed on a second pair of opposite side surfaces of said housing; and wherein each retaining portion includes a first ridge portion which is formed at and protrudes from an upper portion of the side surface of said housing, and is disposed perpendicularly to a longitudinal axis of said housing, and two second ridge portions which protrude from the side surface of said housing, extend perpendicularly from opposite ends of said first ridge portion, respectively, and are disposed parallel to the longitudinal axis of said housing.

5. A fuse according to claim 4, wherein a pair of the retaining portions are provided on opposite side faces of said housing so that the retaining portions are aligned with terminal portions of the fuse body.

6. A fuse according to claim 4 wherein a pair of the retaining portions are provided on opposite side faces of said housing so that the retaining portions are aligned in an extending direction of a fusible portion of the fuse body.

* * * * *